US008575837B2

(12) United States Patent
Matsumoto et al.

(10) Patent No.: US 8,575,837 B2
(45) Date of Patent: Nov. 5, 2013

(54) HIGH PRESSURE DISCHARGE LAMP

(75) Inventors: Yasuhisa Matsumoto, Gyoda (JP); Toshio Yoshizawa, Gyoda (JP); Atsushi Ohno, Gyoda (JP)

(73) Assignee: Iwasaki Electric Co., Ltd., Chuo-ku, Tokyo (JP)

( * ) Notice: Subject to any disclaimer, the term of this patent is extended or adjusted under 35 U.S.C. 154(b) by 0 days.

(21) Appl. No.: 13/811,469

(22) PCT Filed: Jun. 23, 2011

(86) PCT No.: PCT/JP2011/064399
§ 371 (c)(1),
(2), (4) Date: Jan. 22, 2013

(87) PCT Pub. No.: WO2012/014608
PCT Pub. Date: Feb. 2, 2012

(65) Prior Publication Data

US 2013/0119853 A1 May 16, 2013

(30) Foreign Application Priority Data

Jul. 26, 2010 (JP) ..... 2010-166765

(51) Int. Cl.
*H01J 17/20* (2012.01)

(52) U.S. Cl.
USPC ..... 313/571; 313/623; 313/626

(58) Field of Classification Search
None
See application file for complete search history.

(56) References Cited

U.S. PATENT DOCUMENTS

| | | | | |
|---|---|---|---|---|
| 5,142,195 | A * | 8/1992 | Heider et al. | 313/623 |
| 8,082,305 | B2 * | 12/2011 | Daigle et al. | 709/206 |
| 2003/0052603 | A1 | 3/2003 | Takahashi et al. | |
| 2005/0040768 | A1 * | 2/2005 | Kato et al. | 313/635 |
| 2005/0082986 | A1 | 4/2005 | Takezawa et al. | |
| 2005/0122047 | A1 * | 6/2005 | Kato et al. | 313/631 |
| 2010/0013369 | A1 | 1/2010 | Kitahara et al. | |
| 2010/0188855 | A1 * | 7/2010 | Sakaguchi et al. | 362/296.09 |
| 2010/0231872 | A1 | 9/2010 | Kitahara et al. | |
| 2012/0153819 | A1 * | 6/2012 | Matsumoto et al. | 313/631 |

FOREIGN PATENT DOCUMENTS

| | | |
|---|---|---|
| JP | 3493194 | 11/2003 |
| JP | 2005-070589 | 3/2005 |

(Continued)

OTHER PUBLICATIONS

International Search Report for Application Serial No. PCT/JP2011/064399 dated Aug. 30, 2011.

(Continued)

*Primary Examiner* — Ashok Patel
(74) *Attorney, Agent, or Firm* — Eric J. Robinson; Robinson Intellectual Property Law Office, P.C.

(57) ABSTRACT

A high pressure discharge lamp of the present invention is provided with a light-emitting bulb comprising a light-emitting part and sealing sections; metal foils embedded within the sealing sections; and a pair of electrodes having one end protruding into the light-emitting part and having the other end embedded in the corresponding sealing section and joined to the corresponding metal foil. An embedded length L (mm) of the electrodes that is defined by the length between a light-emitting part side end of the metal foil and the border section between the protruding section and the embedded section of the electrode, and the temperature T (° C.) at the joint region of the electrode and the metal foil are set to satisfy $1.8 \leq L \leq 2.8$ and $T \leq 970$.

6 Claims, 2 Drawing Sheets

(56) References Cited

FOREIGN PATENT DOCUMENTS

| | | |
|---|---|---|
| JP | 2005-122955 | 5/2005 |
| JP | 2007-012508 | 1/2007 |
| JP | 2007-123017 | 5/2007 |
| JP | 2008-251391 | 10/2008 |
| JP | 2009-043701 | 2/2009 |
| JP | 2009-266651 | 11/2009 |
| JP | 2010-129426 | 6/2010 |
| WO | WO 2008/023492 | 2/2008 |
| WO | WO 2009/069245 | 6/2009 |

OTHER PUBLICATIONS

Notification of Transmittal of Translation of the International Preliminary Report on Patentability (Application No. PCT/JP2011/064399) dated Feb. 28, 2013.

* cited by examiner

HIGH PRESSURE DISCHARGE LAMP

TECHNICAL FIELD

The present invention relates generally to a high pressure discharge lamp, and more specifically to improvement in reliability of a structure in the vicinity of an electrode and a sealing section of a high pressure discharge lamp.

BACKGROUND ART

An ultra-high pressure mercury lamp used typically as a light source for a projector includes a light-emitting bulb having a light-emitting part and a pair of sealing sections interposing the light-emitting part, a pair of metal foils respectively embedded in the sealing sections, a pair of electrodes each having one end protruding into the light-emitting part and having the other end embedded in the corresponding sealing section and joined to the corresponding metal foil, and a pair of leads respectively connected to the metal foils and configured to supply power to the electrodes. Then, high luminance is achieved by increasing a mercury vapor pressure inside the light-emitting part when discharging.

Here, various countermeasures have been proposed in order to prevent failures due to insufficient strength at sealing sections, especially in the vicinity of sections where the electrodes and the metal foils are joined.

Patent Document 1 discloses a technique for reducing a load on a sealing section and preventing a breakage thereof in a way that a stress in the vicinity of an electrode is adjusted by selecting the material of the electrode or by winding a coil to the electrode.

Patent Document 2 discloses a technique for decreasing a difference in thermal expansion between an electrode and quartz glass at a sealing section by wrapping a metal foil around the electrode, and thereby preventing a failure of the sealing section attributed to the difference in thermal expansion.

CITATION LIST

Patent Documents

Patent Document 1: Japanese Patent No. 3493194

Patent Document 2: Japanese Patent Application Laid-Open No. 2009-043701

SUMMARY OF INVENTION

Technical Problem

However, an arrangement according to Patent Document 1 or Patent Document 2 requires a change of the material of an electrode from a general-purpose material, addition of a coil as a new component, or complication of a structure of a metal foil. Any of these cases leads to a cost increase due to not only addition of the material but also an additional manufacturing process, and is therefore unfavorable.

In view of the above, an object of the present invention is to provide a high pressure discharge lamp with high reliability, which is capable of preventing a failure due to insufficient strength at a sealing section, especially in the vicinity of a joint region of an electrode and a metal foil, without requiring the cost increase as mentioned above.

Solution to Problem

A first aspect of the present invention is a high pressure discharge lamp comprising: a light-emitting bulb including a light-emitting part, and first and second sealing sections interposing the light-emitting part; first and second metal foils embedded in the first and second sealing sections, respectively; first and second electrodes each having one end protruding into the light-emitting part and having the other end embedded in the corresponding one of the first and second sealing sections and joined to the corresponding one of the first and second metal foils; and a sub-mirror covering at least a portion on a second electrode side of the light-emitting bulb, in which an embedded length L (mm) of the second electrode that is defined as a distance from a border section between a protruding section and an embedded section of the second electrode to a light-emitting part side end of the second metal foil, and a temperature T (° C.) at a joint region of the second electrode and the second metal foil satisfy $1.8 \leq L \leq 2.8$ and $T \leq 970$.

A second aspect of the present invention is a high pressure discharge lamp including: a light-emitting bulb including a light-emitting part and a sealing section; a metal foil embedded in the sealing section; and an electrode having one end protruding into the light-emitting part and having the other end embedded in the sealing section and joined to the metal foil, in which an embedded length L (mm) of the electrode that is defined as a distance from a border section between a protruding section and an embedded section of the electrode to a light-emitting part side end of the metal foil, and a temperature T (° C.) at a joint region of the electrode and the metal foil satisfy $1.8 \leq L \leq 2.8$ and $T \leq 970$.

In the first and the second aspects, the embedded length preferably satisfies $2.0 \leq L \leq 2.8$, and more preferably satisfies $L=2.8$.

DESCRIPTION OF EMBODIMENTS

Figure 1A:
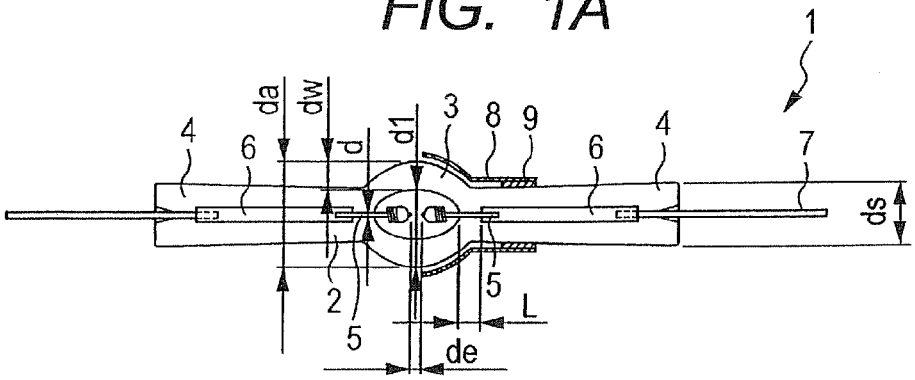
FIG. 1A is a view of a high pressure discharge lamp of the present invention.

FIG. 1A shows a high pressure discharge lamp (hereinafter referred to as a "lamp") according to the present invention. Although its general arrangement is similar to that of a typical lamp, dimensions for positioning respective components are improved therewith.

A lamp 1 includes a light-emitting bulb 2 having a light-emitting part 3 and a pair of sealing sections interposing the light-emitting part 3, a pair of metal foils 6 respectively embedded in the sealing sections 4, a pair of electrodes 5 each having one end protruding into the light-emitting part 3 and having the other end embedded in the corresponding sealing section 4 and joined to the corresponding metal foil 6, and a pair of leads 7 respectively connected to the metal foils 6 and configured to supply power to the electrodes 5. The term "joining" in the present invention refers to welding in the following embodiment. It is to be noted, however, that the joining may also include modes other than welding (such as a form of fitting).

A sub-mirror 8 covering the light-emitting bulb 2 in a range from the metal foil 6 on the right side in the drawing to the light-emitting part 3 may be attached to the light-emitting bulb 2 by use of an adhesive 9. The sub-mirror 8 is located at a predetermined space from the light-emitting part 3 and is fixed to the sealing section 4 using a fixing material (the adhesive 9) such as inorganic cement.

Each electrode includes an electrode rod, and a melted tip section and a coil section collectively constituting a discharge section on a tip. A distance from a border section between a protruding section and an embedded section of the electrode 5 to an end of the metal foil 6 near the light-emitting part is defined as an embedded length L (mm) of the electrode 5. Note that the numerical value of the embedded length L in this specification is assumed to have two significant figures in consideration of a size tolerance. In other words, an expression L=2.8 may represent a numerical value equal to or greater than 2.75 but smaller than 2.85, for example.

In the meantime, as a result of analyzing a failure of a sealing section in a conventional configuration, it is found out that a detachment phenomenon (foil delamination) between quartz glass constituting a light-emitting bulb and a metal foil occurs in the vicinity of a section where an electrode is welded to the metal foil, and that the detachment progresses with discharging time of a lamp and eventually leads to a breakage of the sealing section. The occurrence of the detachment phenomenon is caused by a series of harsh conditions including a thermal shock due to a rise in temperature in the vicinity of a welded section and a stress due to an increase in a mercury vapor pressure during the drive.

Meanwhile, when the sealing section is provided with the sub-mirror as described above, the thermal shock is facilitated by the increase in temperature in the vicinity of the welded section. In addition, although the mercury vapor pressure of a light-emitting part is usually set in a range from 150 to 200 atmospheric pressure, a pressure capacity (mechanical strength) of such the light-emitting part needs to be increased when the light-emitting part for a range from 200 to 300 atmospheric pressure or higher is put into practice in the future.

Note that the detachment phenomenon means detachment of a portion between the quartz glass and a metal foil collectively constituting the sealing section, which are supposed to be attached firmly to each other under normal conditions. Usually, when an electrode rod has a circular cross section, the quartz glass does not reach a joint region between the electrode rod and the metal foil and a gap is therefore formed in the region. However, this specification does not intend to include such a gap in the detachment phenomenon.

Figure 2A:
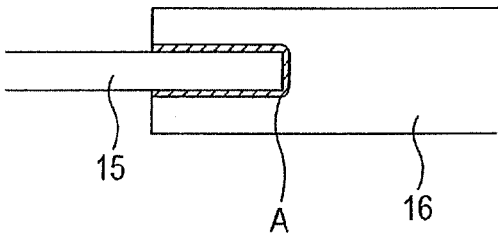
FIG. 2A is a view for explaining a detachment phenomenon.
Figure 2B:
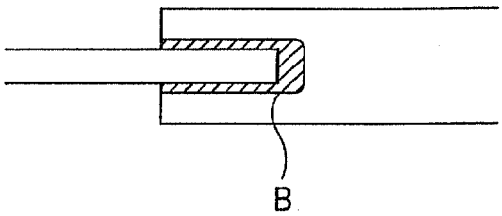
FIG. 2B is a view for explaining the detachment phenomenon.
Figure 2C:
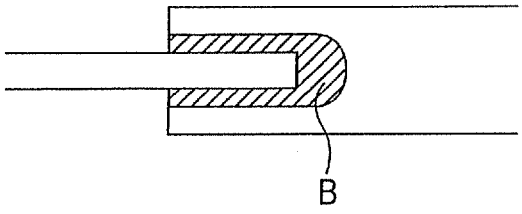
FIG. 2C is a view for explaining the detachment phenomenon.
Figure 2D:
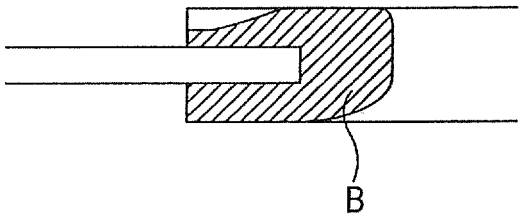
FIG. 2D is a view for explaining the detachment phenomenon.

FIGS. 2A to 2D are views for explaining a detachment phenomenon. In the drawings, an electrode 15 having a circular section rod is joined to a metal foil 16. FIG. 2A shows a normal state in which a gap A is present as described above. Then, as detachment B occurs as shown in FIG. 2B due to the increases in the temperature and the internal pressure as described above, the detachment B develops and progresses over time as shown in FIGS. 2C and 2D.

Here, the pressure capacity of the sealing section is ensured by setting the embedded length L in an appropriate range. Specifically, if the embedded length L is shorter than an appropriate value, the pressure inside the light-emitting part is more likely to act on the metal foil (the welded section in particular) via the electrode rod, and the detachment is more likely to occur as a consequence. Moreover, the welded section is more likely to be affected by the increase in temperature of the light-emitting part and the detachment is more likely to occur as a consequence. On the other hand, if the embedded length L is longer than an appropriate value, a crack is likely to occur at the sealing section in the vicinity of the electrode rod, and therefore the lamp failure is likely to occur in a mode different from the detachment.

(Experiment 1)

Figure 1B:
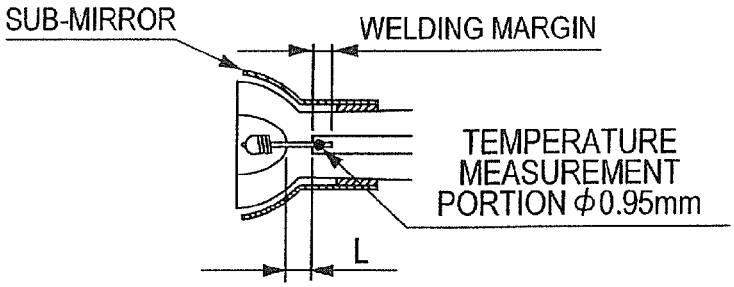
FIG. 1B is an enlarged view of a substantial part of FIG. 1A.

In this experiment, an incidence of failure in the case of continuous drive (discharging) for 1000 hours was examined with various the embedded lengths L. Dimensions of the respective components of the used lamp are as follows (see FIG. 1A). The light-emitting part 3 has an outside diameter da of about 10.3 mm, an inside diameter di of about 4.75 mm, a thickness dw of about 2.7 mm, and an internal capacity of about 0.086 cc. The light-emitting part 3 is made of highly pure quartz glass. Each electrode 5 has an electrode rod diameter d of 0.45 mm. Here, a coil is wound around a tip section and a capacity of the tip section is ensured by melting the tip section. A projection is formed at the tip section by aging and a clearance de between both of the electrodes is set to 1.0±0.1 mm. The sealing section 4 has an outside diameter ds of about Ψ6 mm. Moreover, the lamp is provided with the sub-mirror 8 as shown in FIGS. 1A and 1B.

Mercury is used as a light-emitting material. About 280 mg/cc of mercury, 20 kPa of a noble gas (such as argon), and a small amount of a halogen are filled in the light-emitting part 3. Although this example assumes an ultra-high pressure mercury lamp, the present invention is also applicable to discharge lamps using other filled materials. Note that input lamp power is 230 W in this example.

In the experiment, presence of a failure was observed for each time unit elapsed for various electrode lengths, a welding margin (see FIG. 1B), and the embedded length L. Table 1 shows results of the experiment. Here, the electrode length means a total length of the electrode prior to the melting process of the tip section while the welding margin means a length of the welded section where a rear end side of the electrode overlaps the metal foil. As apparent from the experiment results, the electrode length and the welding margin do not directly affect the experiment results. In other words, the electrode length and the welding margin are set appropriately in order to adjust the embedded length. It is noted that the welding margin is preferably set in a range from 1.0 mm to 2.0 mm in consideration of ensuring weld strength and the like.

TABLE 1

| | electrode length | welding margin | embedded length | elapsed time (h) | | | | |
|---|---|---|---|---|---|---|---|---|
| No. | (mm) | (mm) | (mm) | 200 | 500 | 750 | 1000 | result |
| 01 | 8.0 | 2.0 | 1.3 | normal | normal | detachment | detachment | bad |
| 02 | 8.5 | 2.0 | 1.8 | normal | normal | normal | normal | good |
| 03 | 8.5 | 1.5 | 2.0 | normal | normal | normal | normal | good |
| 04 | 8.0 | 1.5 | 2.1 | normal | normal | normal | normal | good |
| 05 | 8.0 | 1.0 | 2.6 | normal | normal | normal | normal | good |
| 06 | 8.5 | 1.0 | 2.8 | normal | normal | normal | normal | good |
| 07 | 9.5 | 2.0 | 2.9 | normal | normal | normal | crack | bad |
| 08 | 9.5 | 1.5 | 3.7 | normal | normal | normal | crack | bad |
| 09 | 9.5 | 1.0 | 3.7 | normal | normal | normal | crack | bad |

As apparent from Table 1, detachment occurred at the embedded length L of 1.3, and a failure due to a crack on the sealing section around the electrode rod occurred at the embedded length L equal to or above 2.9. Accordingly, the embedded length L should meet 1.8≤L in terms of prevention of the detachment and should meet L≤2.8 in terms of prevention of a crack. That is, 1.8≤L≤2.8 should be satisfied in order to ensure strength for practical use.

(Experiment 2)

In this experiment, an incidence of failure in the case of continuous drive for 1500 hours was investigated with various temperatures T at the welded section. The temperature at the welded section was measured from a side of the sub-mirror 8 side the metal foil 6 (the left side in FIG. 1B) with a radiation thermometer having a measurement diameter of 0.95 mm. Results are shown on Table 2. Specifications of the dimensions of the lamp used in this experiment are similar to those in Experiment 1. However, a relation between an embedded length and the temperature at the welded section is different from that of Experiment 1 due to different measurement conditions. Accordingly, description related to the dimensions provided on Table 2 is just for reference.

TABLE 2

| No. | temperature T at welded section | number of module | number of detachment | incidence of detachment (%) | result | electrode length (mm) | welding margin (mm) | embedded length (mm) |
|---|---|---|---|---|---|---|---|---|
| 11 | 1000 | 29 | 10 | 34 | bad | 8.0 | 1.7 | 2.0 |
| 12 | 970 | 14 | 0 | 0 | good | 8.0 | 1.6 | 2.1 |
| 13 | 930 | 9 | 0 | 0 | good | 8.3 | 1.5 | 2.4 |
| 14 | 900 | 2 | 0 | 0 | good | 8.3 | 1.5 | 2.6 |

As apparent from Table 2, no detachment occurred at the temperature of the welded section equal to or below 970° C. Thus, the lamp therefore needs to be designed such that the temperature T (° C.) meets T≤970. For example, selection of the embedded length L, design of the sub-mirror 8, a cooling method in the case of use for a projector, and the like need to be carried out so as to meet T≤970. In particular, the temperature at the welded section becomes lower as the embedded length L is set longer.

Although the following is not listed on Table 2, a turning on-off test (ON for 3 hours and 30 minutes and then OFF for 30 minutes) was carried out based on specifications according to No. 11 and in the number of modules equal to 26. The number of modules with detachment was 10 (an incidence of detachment equal to 38%). Thus, it was confirmed that the detachment would further be facilitated by a difference in thermal expansion between the materials caused by turning on and off.

(Experiment 3)

Figure 3:
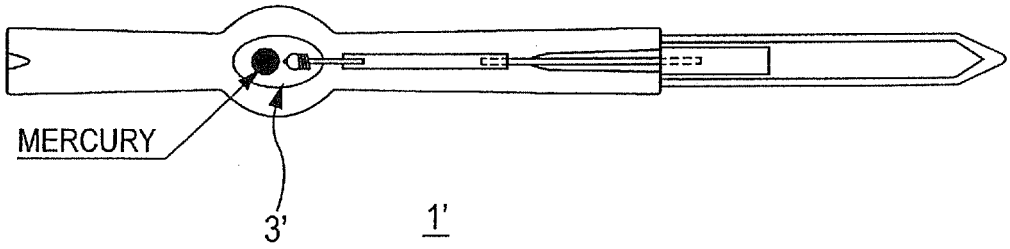
FIG. 3 is a view for explaining a pressure proof test.

In this experiment, the pressure capacity was verified by setting the mercury vapor pressure to 350 atmospheric pressure (35 MPa), which is higher than a typical level. Specifically, an excessive amount (699 mg/cc) of mercury was filled in a sealing container 3' of a lamp 1', which is provided with one electrode only as shown in FIG. 3. The lamp 1' was put into an air atmosphere furnace body and an internal pressure of the sealing container 3' is set to 350 atmospheric pressure by increasing the temperature to 1050° C. Then, presence of a failure (a breakage) was checked. Here, it is only possible to check the mechanical strength of the sealing section 4 against the internal pressure of the sealing container 3'. In this context, no temperature factors are assumed to affect the experiment results. Table 3 shows the results of the experiment.

TABLE 3

| No. | electrode length (mm) | welding margin (mm) | embedded length (mm) | number of test | number of failure | incidence of failure (%) | Result |
|---|---|---|---|---|---|---|---|
| 21 | 8.0 | 2.0 | 1.3 | 5 | 3 | 60 | Bad |
| 22 | 8.5 | 2.0 | 1.8 | 4 | 3 | 75 | Bad |
| 23 | 8.5 | 1.5 | 2.0 | 4 | 1 | 25 | tolerable |
| 24 | 8.0 | 1.5 | 2.1 | 4 | 1 | 25 | Tolerable |
| 25 | 8.0 | 1.0 | 2.6 | 4 | 1 | 25 | Tolerable |
| 26 | 8.5 | 1.0 | 2.8 | 4 | 0 | 0 | Good |
| 27 | 9.5 | 2.0 | 2.9 | 4 | 0 | 0 | good |
| 28 | 9.5 | 1.5 | 3.7 | 4 | 2 | 50 | Bad |

As apparent from Table 3, the incidence of failure can be reduced to 25% or below by setting an embedded length L in a range of 2.0≤L≤2.9. The incidence of failure of 25% is a tolerable incidence considering the accelerated testing at 350 atmospheric pressure. In addition, the lamp is confirmed to be endurable up to 350 atmospheric pressure by setting the embedded length L in a range of 2.8≤L≤2.9 (i.e., the incidence of failure equal to 0%).

The results of Experiments 1 to 3 described above indicate that reliability in actual use can be ensured if the embedded length L and the temperature T at the welded section are set to satisfy at least 1.8≤L≤2.8 and T<970.

Moreover, the results of Experiment 3 indicate that it is preferable to satisfy 2.0≤L in order to obtain a low incidence of failure when the pressure inside the lamp is increased.

Furthermore, the results of Experiment 3 indicate that a highly reliable the lamp can be obtained by setting L=2.8.

Note that the above-mentioned conditions also apply to a lamp without a sub-mirror.

As described above, a high pressure discharge lamp with high reliability can be achieved while preventing a failure which would otherwise be caused by insufficient strength at a sealing section, especially in the vicinity of a joint region of an electrode and a metal foil, by setting an embedded length L of the electrode and a temperature T at a welded section in appropriate ranges, respectively.

REFERENCE NUMERALS

1 high pressure discharge lamp
2 light-emitting bulb
3 light-emitting part
4 sealing section
5 electrode
6 metal foil
7 lead
8 sub-mirror
9 adhesive
L embedded length

The invention claimed is:

1. A high pressure discharge lamp comprising:

a light-emitting bulb including a light-emitting part, and first and second sealing sections interposing the light-emitting part;

first and second metal foils embedded in the first and second sealing sections, respectively;

first and second electrodes each having one end protruding into the light-emitting part and having the other end embedded in the corresponding one of the first and second sealing sections and joined to the corresponding one of the first and second metal foils; and a sub-mirror covering at least a portion on a second electrode side of the light-emitting bulb without covering the first electrode side of the light-emitting bulb, wherein the light-emitting bulb comprises quartz glass, and an embedded length L (mm) of the second electrode that is defined as a distance from a border section between a protruding section and an embedded section of the second electrode to a light-emitting part side end of the second metal foil, and a temperature T (° C.) at a joint region of the second electrode and the second metal foil during a discharging of the lamp satisfy $1.8 \leq L \leq 2.8$ and $T \leq 970$ so that the quartz glass and the second metal foil do not detach by the discharging of the lamp.

2. The high pressure discharge lamp according to claim 1, wherein the embedded length L satisfies $2.0 \leq L \leq 2.8$.

3. The high pressure discharge lamp according to claim 1, wherein the embedded length satisfies $L=2.8$.

4. A high pressure discharge lamp comprising:

a light-emitting bulb including a light-emitting part and a sealing section;

a metal foil embedded in the sealing section; and an electrode having one end protruding into the light-emitting part and having the other end embedded in the sealing section and joined to the metal foil, wherein the light-emitting bulb comprises quartz glass, and an embedded length L (mm) of the electrode that is defined as a distance from a border section between a protruding section and an embedded section of the electrode to a light-emitting part side end of the metal foil, and a temperature T (° C.) at a joint region of the electrode and the metal foil during a discharging of the lamp satisfy $1.8 \leq L \leq 2.8$ and $T \leq 970$ so that the quartz glass and the second metal foil do not detach by the discharging of the lamp.

5. The high pressure discharge lamp according to claim 4, wherein the embedded length L satisfies $2.0 \leq L \leq 2.8$.

6. The high pressure discharge lamp according to claim 4, wherein the embedded length L satisfies $L=2.8$.

* * * * *